US011353184B2

(12) United States Patent
Li et al.

(10) Patent No.: US 11,353,184 B2
(45) Date of Patent: Jun. 7, 2022

(54) LED BULB

(71) Applicant: ZHEJIANG YANKON MEGA LIGHTING CO., LTD., Zhejiang (CN)

(72) Inventors: Yang Li, Zhejiang (CN); Huanliang Wang, Zhejiang (CN); Xuan Zhao, Zhejiang (CN); Jibo Wang, Zhejiang (CN); Bin Yu, Zhejiang (CN)

(73) Assignee: ZHEJIANG YANKON MEGA LIGHTING CO., LTD., Zhejiang (CN)

( * ) Notice: Subject to any disclaimer, the term of this patent is extended or adjusted under 35 U.S.C. 154(b) by 185 days.

(21) Appl. No.: 16/642,365

(22) PCT Filed: Jan. 22, 2020

(86) PCT No.: PCT/CN2020/073721
§ 371 (c)(1),
(2) Date: Feb. 26, 2020

(87) PCT Pub. No.: WO2021/114466
PCT Pub. Date: Jun. 17, 2021

(65) Prior Publication Data

US 2021/0404618 A1 Dec. 30, 2021

(30) Foreign Application Priority Data

Dec. 10, 2019 (CN) ..... 201911255562.X
Dec. 10, 2019 (CN) ..... 201922195026.7

(51) Int. Cl.
*F21S 10/02* (2006.01)
*H05B 45/20* (2020.01)
(Continued)

(52) U.S. Cl.
CPC ..... *F21S 10/02* (2013.01); *F21V 19/006* (2013.01); *F21V 23/003* (2013.01); *F21V 23/04* (2013.01);
(Continued)

(58) Field of Classification Search
CPC ..... F21S 10/02; F21V 19/006; F21V 23/003; F21V 23/04; H05B 45/20; H01H 1/16; H01H 2003/506
See application file for complete search history.

(56) References Cited

U.S. PATENT DOCUMENTS 7,256,671 B1 * 8/2007 Preaux ..... F21L 14/023 335/205
7,755,461 B1 * 7/2010 Preaux ..... F21V 23/0414 335/207
(Continued)

FOREIGN PATENT DOCUMENTS

CN 102450105 A 5/2012
CN 203099630 U 7/2013
(Continued)

OTHER PUBLICATIONS

International Search Report and the Written Opinion of the International Search Authority for PCT application No. PCT/CN2020/073721.

*Primary Examiner* — Tsion Tumebo
(74) *Attorney, Agent, or Firm* — Yue (Robert) Xu; Apex Attorneys at Law, LLP

(57) ABSTRACT

An LED bulb includes an LED photoelectric module having at least two branches of LED beads with different color temperatures connected in parallel, a control switch connected with one of the branches of LED beads, and an adjustment ring. A total voltage of one branch of LED beads is less than that of each of the other branches of LED beads. The control switch has a ball, the adjustment ring has a magnet, and when the adjustment ring rotates, the magnet draws the ball to roll to switch on or off the control switch. When the control switch is on, the branch of LED beads connected with the control switch is lighted up, and when
(Continued)

the control switch is off, the branch of LED beads connected with the control switch is not lighted up.

12 Claims, 9 Drawing Sheets

(51) Int. Cl.

| | |
|---|---|
| ***F21V 19/00*** | (2006.01) |
| ***F21V 23/00*** | (2015.01) |
| ***F21V 23/04*** | (2006.01) |
| ***H05B 45/52*** | (2020.01) |
| ***H01H 1/12*** | (2006.01) |
| ***H01H 1/16*** | (2006.01) |
| ***H01H 3/50*** | (2006.01) |

(52) U.S. Cl.
CPC ..... *H05B 45/20* (2020.01); *H01H 1/12* (2013.01); *H01H 1/16* (2013.01); *H01H 2003/506* (2013.01); *H05B 45/52* (2020.01)

(56) References Cited

U.S. PATENT DOCUMENTS

| | | | | |
|---|---|---|---|---|
| 8,421,376 | B2 * | 4/2013 | Jonsson | F21V 3/02 315/318 |
| 8,729,826 | B2 * | 5/2014 | Jonsson | H05B 45/14 315/297 |
| 9,087,514 | B2 * | 7/2015 | Jonsson | H04L 12/2827 |
| 9,657,928 | B1 * | 5/2017 | Jacobson | F21V 23/04 |
| 10,104,742 | B2 * | 10/2018 | Halliwell | F21K 9/65 |
| 10,893,587 | B2 * | 1/2021 | Halliwell | F21V 19/006 |
| 10,914,429 | B1 * | 2/2021 | Liu | F21K 9/237 |
| 2007/0121317 | A1 | 5/2007 | Huang et al. | |
| 2011/0095709 | A1 * | 4/2011 | Diehl | F21V 3/02 315/363 |
| 2012/0091899 | A1 | 4/2012 | Tokura | |
| 2019/0230324 | A1 * | 7/2019 | Chien | F21V 14/02 |

FOREIGN PATENT DOCUMENTS

| | | | |
|---|---|---|---|
| CN | 105889779 | A | 8/2016 |
| CN | 106051499 | A | 10/2016 |
| CN | 106764967 | A | 5/2017 |
| CN | 207539766 | U | 6/2018 |

* cited by examiner

LED BULB

The present application is the US national phase of International Patent Application No. PCT/CN2020/073721, titled "LED BULB", filed Jan. 22, 2020, which claims priority to the following Chinese Patent Applications.

1. The Chinese Patent Application No. 201911255562.X, titled "LED BULB", filed on Dec. 10, 2019, with the China National Intellectual Property Administration.
2. The Chinese Patent Application No. 201922195026.7, titled "LED BULB", filed on Dec. 10, 2019, with the China National Intellectual Property Administration.

All the aforementioned applications are incorporated herein by reference in their entirety.

TECHNICAL FIELD

The present disclosure relates to the technical field of LED bulb, particularly to an LED bulb.

BACKGROUND

A conventional LED bulb generally include a bulb body, on which a switch for performing dimmer control and toning control is installed. In an American family, the dimmer control and toning control are generally performed by the switch installed on the bulb body. Different color temperature or brightness can be achieved by shifting the switch into different gears. However, the design of the switch installed on the bulb body of the LED bulb in an aspect ruins an overall structure of the bulb body and affects the aesthetics of the bulb body, and in another aspect increases difficulty in mold designing of the bulb body, thereby increasing costs.

SUMMARY

The present disclosure is mainly to solve the technical problems described above in conventional technologies by providing an LED bulb.

The above technical problems mentioned in the present disclosure are resolved through the technical solutions described below. An LED bulb is provided, including a bulb body, an LED photoelectric module installed on top of the bulb body. The LED photoelectric module has at least two branches of LED beads, and the at least two branches of LED beads have different color temperatures and are connected in parallel with each other. The LED bulb further includes a control switch and an adjustment ring. The control switch is arranged inside the bulb body and near an inner wall of the bulb body and is connected in series with a connection circuit of one branch of the at least two branches of LED beads with different color temperatures, and a total voltage of one branch of the at least two branches of LED beads with different color temperatures is less than a total voltage of each of the other of the at least two branches of LED beads with different color temperatures. The adjustment ring is installed around the bulb body, the control switch has a ball, the adjustment ring has a magnet, and the adjustment ring rotates about the bulb body, such that the magnet draws the ball to roll, thereby switching on or switching off the control switch. In a case that the control switch is switched on, one branch of the at least two branches of LED beads with different color temperatures that is connected in series with the control switch is lighted up while the other of the at least two branches of LED beads with different color temperatures is not lighted up; and in a case that the control switch is switched off, one branch of the at least two branches of LED beads with different color temperatures that is connected in series with the control switch is not lighted up while the other of the at least two branches of LED beads with different color temperatures is lighted up.

The control switch includes a hollow metallic guide tube, a first electrode, a second electrode and the ball. One end of the first electrode is connected with the hollow metallic guide tube, another end of the first electrode is inserted in an aluminum substrate in the LED photoelectric module and connected in series with one end of the connection circuit of one branch of the at least two branches of LED beads with different color temperatures in the LED photoelectric module or connected with a driving circuit in the LED photoelectric module. One end of the second electrode is wrapped by an insulating layer and extends into the hollow metallic guide tube, the second electrode is completely insulated from the hollow metallic guide tube by the insulating layer, a tip of one end of the second electrode is exposed from the insulating layer, and another end of the second electrode is inserted in the aluminum substrate in the LED photoelectric module and is connected with the driving circuit in the LED photoelectric module or connected in series with one end of a connection circuit of one branch of the at least two branches of LED beads with different color temperatures. The ball is arranged in the hollow metallic guide tube, the magnet draws the ball to roll to switch off the control switch when the ball is not in contact with the second electrode; and the magnet draws the ball to roll to switch on the control switch when the ball is in contact with the tip of one end of the second electrode. The magnet draws the ball such that the ball rolls in the hollow metallic guide tube with the rotation of the adjustment ring. In a case that the ball rolls to a position close to the first electrode, though the ball is in contact with the hollow metallic guide tube and the first electrode is connected with the hollow metallic guide tube, the second electrode is insulated from the hollow metallic guide tube. Therefore, the connection circuit of one branch of the at least two branches of LED beads with different color temperatures is not conductive. That is, the LED bead in the one branch of the at least two branches of LED beads with different color temperatures is not lighted up, and LED beads in the other of the at least two branches of LED beads with different color temperatures are lighted up, which is referred to as switched-off state of the control switch. In a case that the ball rolls to a position close to the second electrode and is in contact with the tip of one end of the second electrode, the second electrode, the ball, and the hollow metallic guide tube and the first electrode are conductively connected. Because a total voltage of one branch of the at least two branches of LED beads with different color temperatures is less than that of each of the other of the at least two branches of LED beads with different color temperatures, when a current flows through the one branch of the at least two branches of LED beads with different color temperatures, LED beads in the one branch of the at least two branches of LED beads with different color temperatures are lighted up and LED beads in the other of the at least two branches of LED beads with different color temperatures are not lighted up, which is referred to as switched-on state of the control switch.

An outer surface of the hollow metallic guide tube is wrapped by an insulating film such that the hollow metallic guide tube is insulated from the outside.

The control switch is installed on a rear side of the aluminum substrate in the LED photoelectric module such that the addition of the control switch does not affect light emitted from the LED beads.

The adjustment ring includes a ring body and the magnet, the ring body is sleeved on an outer surface of a top portion of the bulb body, and the magnet is installed on an inner wall of the ring body.

The ring body is provided with a first protruded portion and a second protruded portion, the magnet is installed in an inner cavity of the first protruded portion, and a limiting structure is provided between the second protruded portion and the bulb body. The limiting structure includes a spring post arranged in an inner cavity of the second protruded portion in a radial direction, a spring sleeved on an outer surface of the spring post, a limiting steel ball against an inner axial end of the spring, and two arcuate grooves arranged on an outer circumferential wall of the bulb body. In a case that the ball is drawn by the magnet to roll to be in contact with an axial end of the hollow metallic guide tube connected with the first electrode, the limiting steel ball is embedded in one of the two arcuate grooves, and in a case that the ball is drawn by the magnet to roll to be in contact with the tip of one end of the second electrode, the limiting steel ball is embedded in the other of the two arcuate grooves. The first protruded portion provides space for installation of the magnet and facilitates rotating the adjustment ring manually; similarly, the second protruded portion provides space for installation of the limiting structure and facilitates rotating the adjustment ring manually; provision of the limiting structure prevents the adjustment ring from moving in a case that the adjustment ring is touched inadvertently.

A rotation range of the adjustment ring is an arcuate distance between the two arcuate grooves.

The ring body is circular or semicircular. A shape of the ring body can be designed as required such that the adjustment ring has a wide applicability scope.

A positioning post is vertically arranged in the bulb body and a positioning hole fitting with the positioning post is provided on the aluminum substrate in the LED photoelectric module. The positioning post mates with the positioning hole, such that the LED photoelectric module can be installed in the bulb body conveniently and it is ensured that the control switch is installed near the magnet, that is, a quick installation of the LED photoelectric module is achieved with the control switch being located between the positioning post and the magnet guaranteed.

The bulb body has a flared shape, and the LED photoelectric module is installed on a wide end of the bulb body. The LED photoelectric module includes an aluminum substrate, at least two branches of LED beads installed on a front surface of the aluminum substrate, and driving components separately installed on the front surface and the rear surface of the aluminum substrate, where the at least two branches of LED beads have different color temperatures and are connected in parallel with each other. The LED bulb further includes a bulb housing and a bulb cap, the bulb housing is arranged above the LED photoelectric module and covering the LED photoelectric module, an opening end of the bulb housing is connected with the wide end of the bulb body, and the bulb cap is screwed to a narrow end of the bulb body. According to the embodiment, LED beads with two different color temperatures, LED beads with a cold color temperature and LED beads with a warm color temperature, are installed. For example, a color temperature of the cold color temperature LED bead is 6500K and a color temperature of the warm color temperature LED bead is 2700K.

The present disclosure has the following advantages over conventional technologies.

A control switch is provided inside the bulb body and an adjustment ring is sleeved on an outer surface of the bulb body. A connection circuit of one branch of the at least two branches of LED beads with different color temperatures that is connected in series with the connection circuit is switched on or off by drawing a ball in the control switch with a magnet in the adjustment ring, thereby achieving dimmer control and toning control without installing a switch on the bulb body. In this way, an overall structure of the bulb body is not ruined, aesthetics of the bulb body is not affected and the difficulty in mold designing of the bulb body is not increased.

DETAILED DESCRIPTION OF THE EMBODIMENTS

Figure 1:
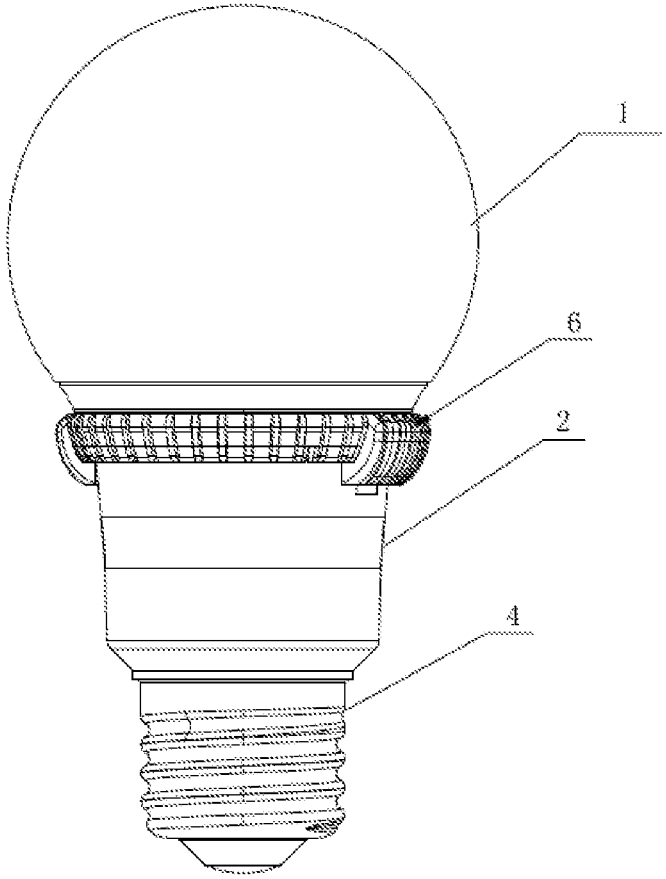
FIG. 1 is an overall structural schematic diagram of an LED bulb according to a first embodiment.
Figure 2:
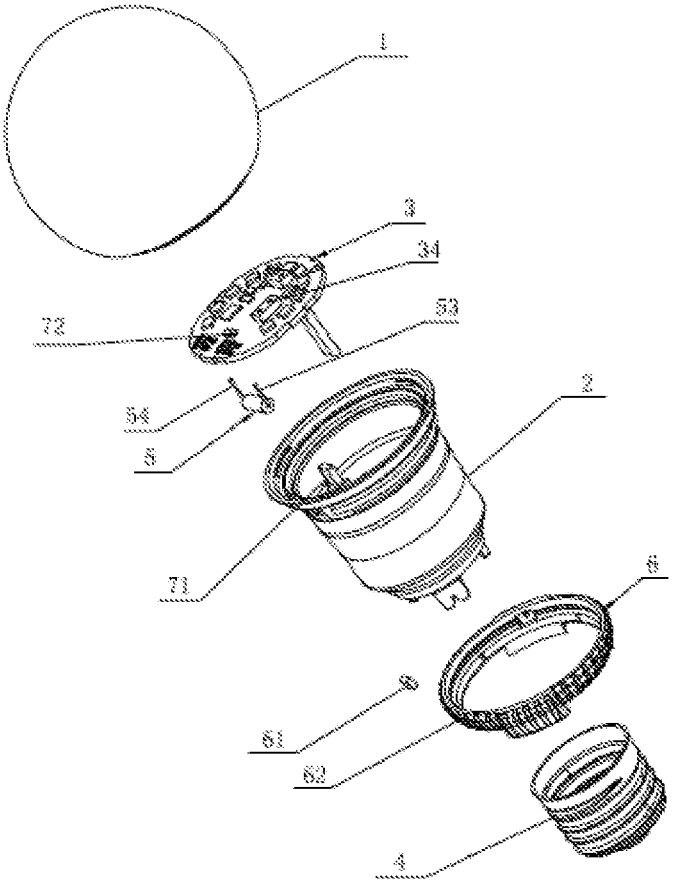
FIG. 2 is an exploded structural schematic diagram of the LED bulb according to the first embodiment.
Figure 3:
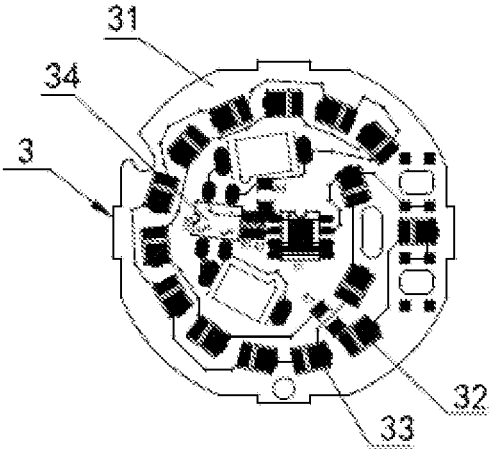
FIG. 3 is a schematic diagram of a circuit connection of an LED photoelectric module in the LED bulb according to the first embodiment.
Figure 4:
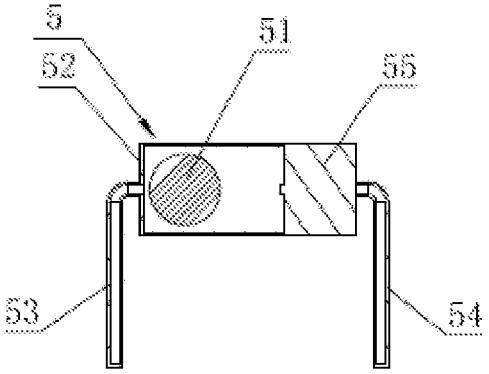
FIG. 4 is a sectional view of a control switch in the LED bulb according to the first embodiment.
Figure 5:
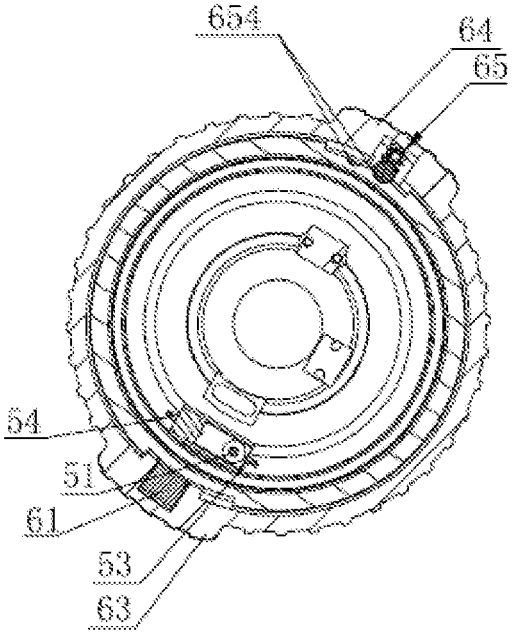
FIG. 5 is a radial sectional view of the LED bulb (the control switch is off) according to the first embodiment.
Figure 6:
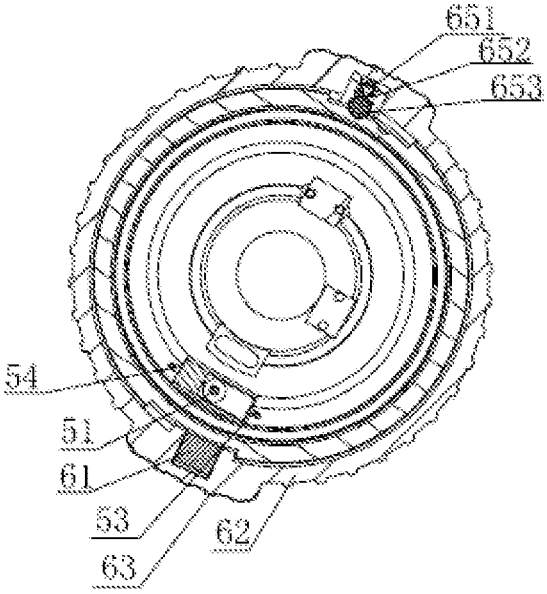
FIG. 6 is a radial sectional view of the LED bulb (the control switch is on) according to the first embodiment.
Figure 7:
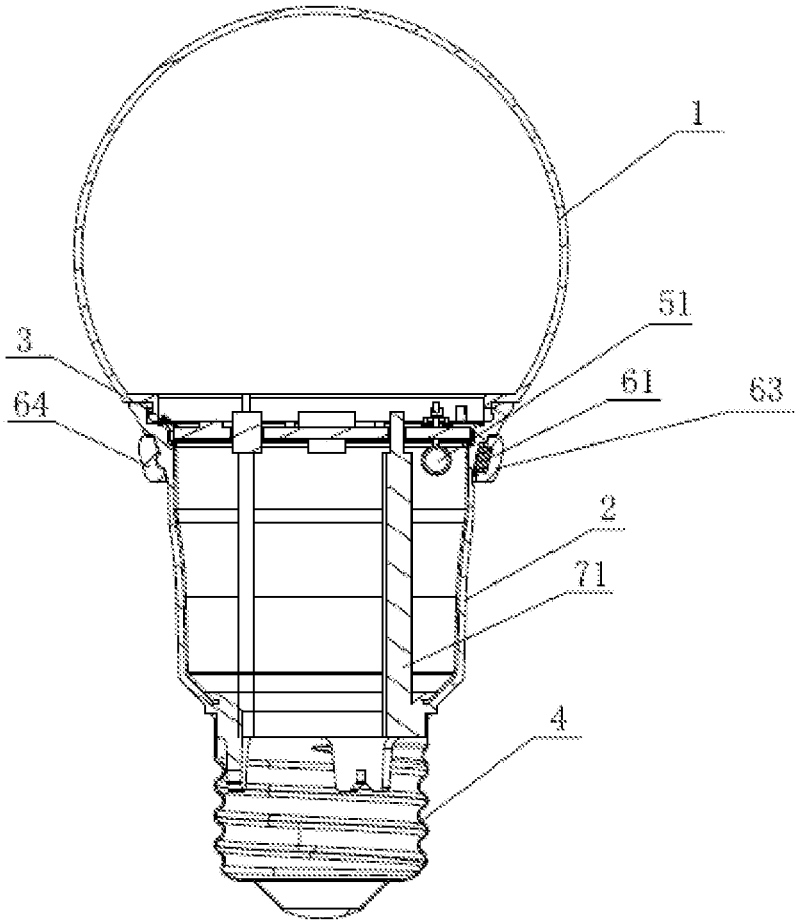
FIG. 7 is an axial sectional view of the LED bulb according to the first embodiment.
Figure 8:
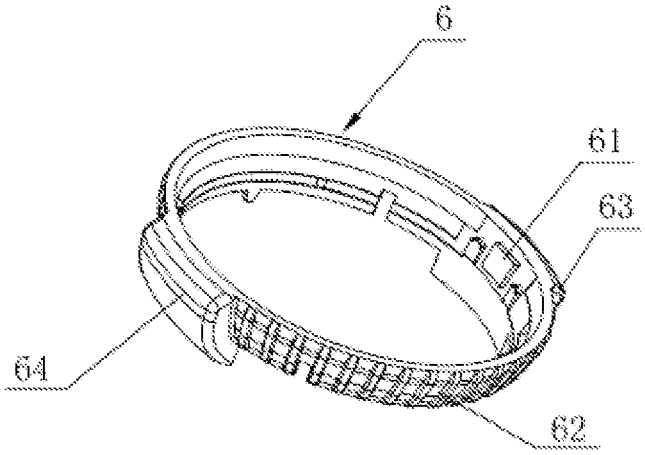
FIG. 8 is a structural schematic diagram of an adjustment ring in the LED bulb according to the first embodiment.

The present disclosure is further described below in conjunction with drawings and detailed description of the embodiments.

First Embodiment

An LED bulb is provided according to the embodiment, as shown in FIGS. 1 to 8 and FIG. 11. The LED bulb includes a bulb housing 1, a bulb body 2 with a flared shape, an LED photoelectric module 3 installed at a wide end of the bulb body 2, a bulb cap 4, a control switch 5 and an adjustment ring 6. The bulb housing 1 is arranged above the LED photoelectric module 3 and covering the LED photoelectric module 3. An opening end of the bulb housing 1 is connected with the wide end of the bulb body 2, and the bulb cap 4 is screwed to a narrow end of the bulb body 2. The LED photoelectric module 3 includes an aluminum substrate 31, a branch of LED beads 32 with a first color temperature, that is, a cold color temperature, a branch of LED beads 33 with a second color temperature, that is, a warm color temperature, and driving components 34 separately installed on a front surface and a rear surface of the aluminum substrate 31, where the branch of LED beads 32 with the first color temperature is connected in parallel with the branch of LED beads 33 with the second color temperature. The control switch 5 is installed on a rear side of the aluminum substrate 31 in the LED photoelectric module 3, such that the addition of the control switch 5 does not affect light emitted from the LED beads. The control switch 5 is close to an inner wall of the bulb body 2 and is connected in series with a connection circuit of the cold color temperature LED beads 32. A total voltage of the cold color temperature LED beads 32 is less than a total voltage of the warm color temperature LED beads 33. In an embodiment, the number of the cold color temperature LED beads 32 is less than that of the warm color temperature LED beads 33; or the number of the cold color temperature LED beads 32 is equal to that of the warm color temperature LED beads 33 but voltages of some or all of the cold color temperature LED beads 32 are less than that of the warm color temperature LED beads 33. The adjustment ring 6 is installed around the bulb body 2. The control switch 5 has a ball 51, and the adjustment ring 6 has a magnet 61. The adjustment ring 6 rotates about the bulb body 2, such that the magnet 61 draws the ball 51 to roll, thereby switching on or switching off the control switch 5. In a case that the control switch 5 is switched on, the cold color temperature LED beads 32 connected in series with the control switch 5 are lighted up while the warm color temperature LED beads 33 are not lighted up; in a case that the control switch 5 is switched off, the cold color temperature LED beads 32 connected in series with the control switch 5 are not lighted up while the warm color temperature LED beads 33 are lighted up.

In the present embodiment, the control switch 5 includes a hollow metallic guide tube 52, a first electrode 53, a second electrode 54 and a ball 51. One end of the first electrode 53 is connected with an axial end of the hollow metallic guide tube 52, and another end of the first electrode 53 is inserted in the aluminum substrate 31 in the LED photoelectric module 3 and connected in series with one end of the connection circuit of the cold color temperature LED beads 32 in the LED photoelectric module 3. One end of the second electrode 54 is wrapped by an insulating layer 55 and extends into the hollow metallic guide tube 52 from another axial end of the hollow metallic guide tube 52. The second electrode 54 is completely insulated from the hollow metallic guide tube 52 by the insulating layer 55. A tip of one end of the second electrode 54 is exposed from the insulating layer 55. Another end of the second electrode 54 is inserted in the aluminum substrate 31 in the LED photoelectric module 3 and connected with a constant current chip U1 in a driving circuit in the LED photoelectric module 3. The ball 51 is arranged in the hollow metallic guide tube 52. The magnet 61 draws the ball 51 to roll such that the control switch 5 is switched off in a case that the ball 51 is not in contact with the second electrode 54. The magnet 61 draws the ball 51 to roll such that the control switch 5 is switched on in a case that the ball 51 is in contact with the tip of one end of the second electrode 54. An outer surface of the hollow metallic guide tube 52 is wrapped by an insulating film (not shown in the Figures), such that the hollow metallic guide tube 52 is insulated from the outside. The magnet 61 draws the ball 51 such that the ball 51 rolls in the hollow metallic guide tube 52 with the rotation of the adjustment ring 6. In a case that the ball 51 rolls to a position close to the first electrode 53, though the ball 51 is in contact with the hollow metallic guide tube 52 and the first electrode 53 is connected with the hollow metallic guide tube 52, the second electrode 54 is insulated from the hollow metallic guide tube 52. Therefore, the connection circuit of the cold color temperature LED beads 32 is not conductive. That is, the cold color temperature LED beads 32 are not lighted up, and the warm color temperature LED beads 33 are lighted up, which is referred to as switched-off state of the control switch 5. In a case that the ball 51 rolls to a position close to the second electrode 54 and is in contact with the tip of one end of the second electrode 54, the second electrode 54, the ball 51, the hollow metallic guide tube 52 and the first electrode 53 are conductively connected, such that the connection circuit of the cold color temperature LED beads 32 is conductive. Because a total voltage of the cold color temperature LED beads 32 is less than that of the warm color temperature LED beads 33, the cold color temperature LED beads 32 are lighted up and the warm color temperature LED beads 33 are not lighted up, when a current flow through the cold color temperature LED bead 32, which is referred to as switched-on state of the control switch.

In the present embodiment, the adjustment ring 6 includes a ring body 62 and the magnet 61, where the ring body 62 is arranged on an outer surface of a top portion of the bulb body 2, the magnet 61 is installed on an inner wall of the ring body 62, and a rotation range of the adjustment ring 6 is a length range of the control switch 5.

In the present embodiment, the ring body 62 is circular.

In the present embodiment, a positioning post 71 is vertically arranged in the bulb body 2 and a positioning hole 72 fitting with the positioning post 71 is provided on the aluminum substrate 31 in the LED photoelectric module 3. The positioning post 71 mates with the positioning hole 72, such that the LED photoelectric module 3 can be installed in the bulb body 2 conveniently and it is ensured that the control switch 5 is near the magnet 61, that is, a quick installation of the LED photoelectric module 3 is achieved with the control switch 5 being located between the positioning post 71 and the magnet 61 guaranteed.

In the present embodiment, two branches of LED beads with different color temperatures, cold color temperature beads and warm color temperature beads, are installed. For example, a color temperature of the cold color temperature LED beads is 6500K and a color temperature of the warm color temperature LED beads is 2700K.

In the present embodiment, as shown in FIG. 5 to FIG. 8, the ring body 62 is provided with a first protruded portion 63 and a second protruded portion 64, the magnet 61 is installed in an inner cavity of the first protruded portion 63, and a limiting structure 65 is provided between the second protruded portion 64 and the bulb body 2. The limiting structure 65 includes a spring post 651 arranged in an inner cavity of the second protruded portion 64 in a radial direction, a spring 652 sleeved on an outer surface of the spring post 651, a limiting steel ball 653 against an inner axial end of the spring 652, and two arcuate grooves 654 arranged on an outer circumferential wall of the bulb body 2. In a case that the ball 51 is drawn by the magnet 61 to roll to be in contact with an axial end of the hollow metallic guide tube 52 connected with the first electrode 53, the limiting steel ball 653 is embedded in one of the two arcuate grooves 654, and in a case that the ball 51 is drawn by the magnet 61 to roll to be in contact with the tip of one end of the second electrode 54, the limiting steel ball 653 is embedded in the other of the two arcuate grooves 654. The first protruded portion 63 provides space for installation of the magnet 61 and facilitates rotating the adjustment ring 6 manually;

similarly, the second protruded portion 64 provides space for installation of the limiting structure 65 and facilitates rotating the adjustment ring 6 manually; provision of the limiting structure 65 prevents the adjustment ring 6 from moving in a case that the adjustment ring is touched inadvertently.

Second Embodiment

Figure 9:
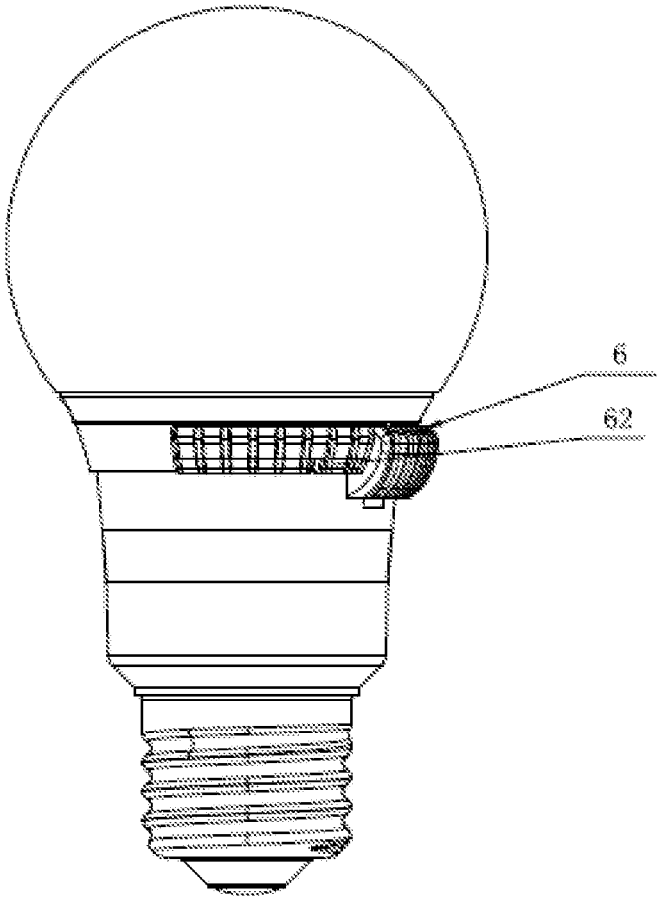
FIG. 9 is an overall structural schematic diagram of an LED bulb according to a second embodiment.
Figure 10:
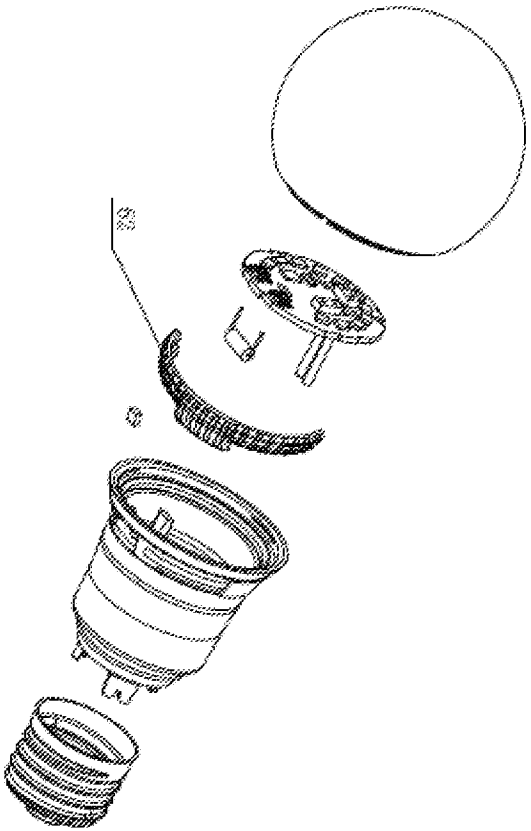
FIG. 10 is an exploded structural schematic diagram of the LED bulb according to the second embodiment.

An LED bulb is provided according to the embodiment, where an overall structure of the LED bulb is the same as that of the LED bulb according to the first embodiment except that as shown in FIG. 9 and FIG. 10, the ring body 62 of the adjustment ring 6 is semicircular. A shape of the ring body 62 can be designed as required in practical design such that the adjustment ring 6 has a wide applicability scope.

Figure 11:
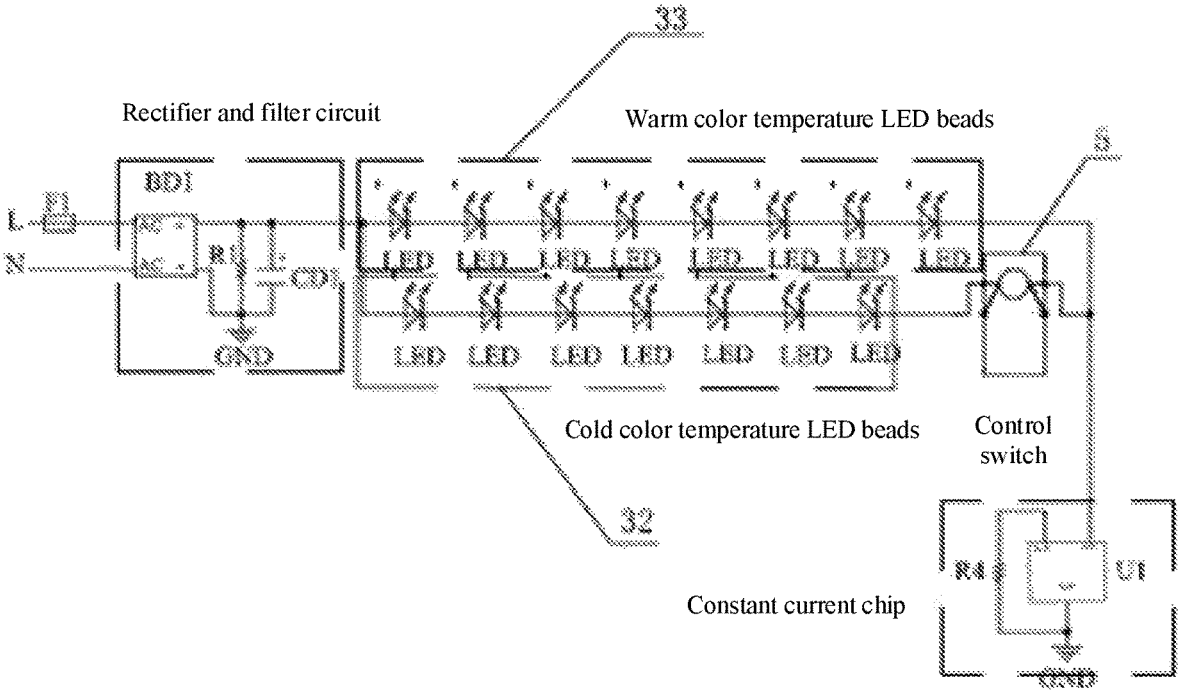
FIG. 11 is a schematic diagram of a circuit connection of a control circuit in an LED bulb according to the present disclosure.

In the above two embodiments, a circuit connection of the control switch 5 is as shown in FIG. 11. A positive terminal of the circuit connection of cold color temperature LED beads 32 is connected with an output terminal of a rectifier and filter circuit, a negative terminal of the circuit connection of cold color temperature LED beads 32 is connected with the first electrode 53 of the control switch 5, a positive terminal of a circuit connection of warm color temperature LED beads 33 is connected with the output terminal of the rectifier and filter circuit, a negative terminal of the circuit connection of warm color temperature LED beads 33 is connected with the constant current chip U1 of the driving circuit, and the second electrode 54 of the control switch 5 is connected with the constant current chip U1 of the driving circuit.

The invention claimed is:

1. An LED bulb, comprising a bulb body, and an LED photoelectric module installed on top of the bulb body, the LED photoelectric module having at least two branches of LED beads and the at least two branches of LED beads having different color temperatures and being connected in parallel with each other, wherein the LED bulb further comprises a control switch and an adjustment ring, the control switch is arranged inside the bulb body and near an inner wall of the bulb body and is connected in series with a connection circuit of one branch of the at least two branches of LED beads with different color temperatures, a total voltage of one branch of the at least two branches of LED beads with different color temperatures is less than a total voltage of each of the other of the at least two branches of LED beads with different color temperatures, the adjustment ring is installed around the bulb body, the control switch comprises a hollow metallic guide tube, a first electrode, a second electrode and a ball, the adjustment ring has a magnet, and the adjustment ring rotates around the bulb body, whereby the magnet draws the ball to roll to switch on or switch off the control switch, wherein in a case that the control switch is switched on, one branch of the at least two branches of LED beads with different color temperatures that is connected in series with the control switch is lighted up and the other of the at least two branches of LED beads with different color temperatures is not lighted up; and in a case that the control switch is switched off, one branch of the at least two branches of LED beads with different color temperatures that is connected in series with the control switch is not lighted up and the other of the at least two branches of LED beads with different color temperatures is lighted up.

2. The LED bulb according to claim 1, wherein:

one end of the first electrode is connected with the hollow metallic guide tube, and another end of the first electrode is inserted in an aluminum substrate in the LED photoelectric module and connected in series with one end of the connection circuit of one branch of the at least two branches of LED beads with different color temperatures in the LED photoelectric module or connected with a driving circuit in the LED photoelectric module;

one end of the second electrode is wrapped by an insulating layer and extends into the hollow metallic guide tube, the second electrode is completely insulated from the hollow metallic guide tube by the insulating layer, a tip of one end of the second electrode is exposed from the insulating layer, another end of the second electrode is inserted in the aluminum substrate in the LED photoelectric module and is connected with the driving circuit in the LED photoelectric module or connected in series with one end of a connection circuit of one branch of the at least two branches of LED beads with different color temperatures; and the ball is arranged in the hollow metallic guide tube, the magnet draws the ball to roll to switch off the control switch when the ball is not in contact with the second electrode, and the magnet draws the ball to roll to switch on the control switch when the ball is in contact with the tip of one end of the second electrode.

3. The LED bulb according to claim 2, wherein an outer surface of the hollow metallic guide tube is wrapped by an insulating film.

4. The LED bulb according to claim 2, wherein the control switch is installed on a rear side of the aluminum substrate in the LED photoelectric module.

5. The LED bulb according to claim 3, wherein the adjusting ring comprises a ring body and the magnet, the ring body is arranged on an outer surface of a top portion of the bulb body, and the magnet is installed on an inner wall of the ring body.

6. The LED bulb according to claim 5, wherein:

the ring body is provided with a first protruded portion and a second protruded portion, the magnet is installed in an inner cavity of the first protruded portion, and a limiting structure is provided between the second protruded portion and the bulb body;

the limiting structure comprises a spring post arranged in an inner cavity of the second protruded portion in a radial direction, a spring sleeved on an outer surface of the spring post, a limiting steel ball against an inner axial end of the spring, and two arcuate grooves arranged on an outer circumferential wall of the bulb body; and in a case that the ball is drawn by the magnet to roll to be in contact with an axial end of the hollow metallic guide tube connected with the first electrode, the limiting steel ball is embedded in one of the two arcuate grooves, and in a case that the ball is drawn by the magnet to roll to be in contact with the tip of one end of the second electrode, the limiting steel ball is embedded in the other of the two arcuate grooves.

7. The LED bulb according to claim 6, wherein a rotation range of the adjustment ring is an arcuate distance between the two arcuate grooves.

8. The LED bulb according to claim 7, wherein the ring body is circular or semicircular.

9. The LED bulb according to claim 1, wherein:

the bulb body has a flared shape, and the LED photoelectric module is installed on a wide end of the bulb body;

the LED photoelectric module comprises an aluminum substrate, at least two branches of LED beads installed on a front surface of the aluminum substrate, and driving components separately installed on the front surface and a rear surface of the aluminum substrate, wherein the at least two branches of LED beads have different color temperatures and are connected in parallel with each other;

the LED bulb further comprises a bulb housing and a bulb cap, the bulb housing is arranged above the LED photoelectric module and covering the LED photoelectric module, an opening end of the bulb housing is connected with the wide end of the bulb body, and the bulb cap is screwed to a narrow end of the bulb body.

10. The LED bulb according to claim 3, wherein the control switch is installed on a rear side of the aluminum substrate in the LED photoelectric module.

11. The LED bulb according to claim 2, wherein a positioning post is vertically arranged in the bulb body and a positioning hole fitting with the positioning post is provided on the aluminum substrate in the LED photoelectric module.

12. The LED bulb according to claim 3, wherein a positioning post is vertically arranged in the bulb body and a positioning hole fitting with the positioning post is provided on the aluminum substrate in the LED photoelectric module.

* * * * *